United States Patent [19]

King

[11] Patent Number: 4,944,126

[45] Date of Patent: Jul. 31, 1990

[54] ATTIC INSULATING SYSTEM

[76] Inventor: Gregory J. King, 5473 Logan St. SE., Rochester, Minn. 55904

[21] Appl. No.: 443,318

[22] Filed: Nov. 30, 1989

[51] Int. Cl.[5] ..... E06B 6/26

[52] U.S. Cl. ..... 52/202; 52/404; 182/81

[58] Field of Search ..... 182/81, 80, 79, 46; 52/404, 19, 202, 210

[56] References Cited

U.S. PATENT DOCUMENTS

| | | | |
|---|---|---|---|
| 4,281,743 | 4/1981 | Fuller | 182/81 |
| 4,312,423 | 1/1982 | Helbig | 182/81 |
| 4,337,602 | 7/1982 | King | 52/202 |
| 4,658,555 | 4/1987 | Steiner | 52/202 |
| 4,832,153 | 5/1989 | Daw | 182/46 |

*Primary Examiner*—John E. Murtagh

*Attorney, Agent, or Firm*—William J. Ryan

[57] ABSTRACT

A system for insulating attics wherein access to the attic is had through an opening defined in the floor of the attic, the opening being normally closed by a trap door, comprising an expandable guard for providing lateral support to insulation adjacent the trap door opening, the guard being adjustably expandable to size and shape generally corresponding to the size and shape of the opening, and a trap door insulating pack comprising a harness enclosing insulating material, the harness being secured to the top side of the trap door.

6 Claims, 3 Drawing Sheets

ATTIC INSULATING SYSTEM

SUMMARY OF THE INVENTION

The present invention relates to an attic insulation system particularly useful in conjunction with the insulation of attics having access by virtue of a trap door extending into the attic through the ceiling of a room below.

Many buildings, particularly homes and residential buildings, have attics located above the habitable or living areas of the building. The floor of these attics typically supports a layer of insulation which inhibits heat transfer through the top of the building. Such insulation may take various forms such as layers of woven fiberglass or blown fiberglass particles. Generally, the degree of insulation is determined in part by the depth of the insulation. Access to such attics, either to originally place the insulation upon construction of the building or thereafter to provide additional insulation, is typically provided by means of a trap door extending through the ceiling of a room below the attic. Because the trap door must be opened or removed to place the insulation, it is impossible to place insulation over the trap door once it is closed. This leaves the trap door uninsulated and reduces the efficiency of the layer of insulation in general. In the case of blown, particulate insulation, which has a tendency to be somewhat free flowing, in addition to the area immediately above the trap door, a gradual decreasing slope or depth of insulation around the trap door must be maintained to prevent the particules of insulation from falling through the trap door as the insulation is being added. This declining slope of insulation further reduces the efficiency of the insulating layer.

To overcome the need to maintain the decreasing slope of insulation, it has been known to construct guards around the trap door extending into the attic at least to the level of the desired depth of insulation. Such guards have typically consisted of a rectangular box having wooden sides that are individually cut and nailed to the rafters or flooring surrounding the trap door. Such boxes have generally been constructed at the job site requiring transportation of tools and materials to the site. This procedure is often cumbersome and more complicated than necessary.

It is one object of the present invention to provide insulation of the area above a trap door providing access to the attic.

It is another object of the present invention to provide a universally adaptable, prefabricated, adjustable trap door guard.

To those ends, the present invention provides a method or system for insulating the trap door of an attic comprising a harness for enclosing insulating material and securing it to the top of the trap door and an adjustable, prefabricated guard for placement around the trap door and having foldable sides that are slidably adjustable with respect to one another.

DETAILED DESCRIPTION OF THE PREFERRED EMBODIMENT

Figure 1:
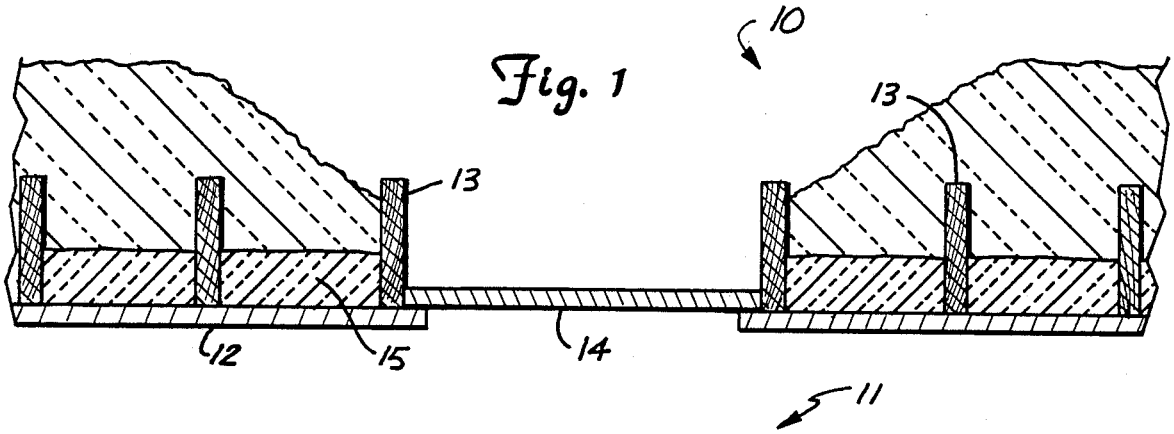
FIG. 1 is a partial side sectional view of a conventionally insulated attic showing an additional layer of insulation having been applied on top of the original insulation layer.
Figure 2:
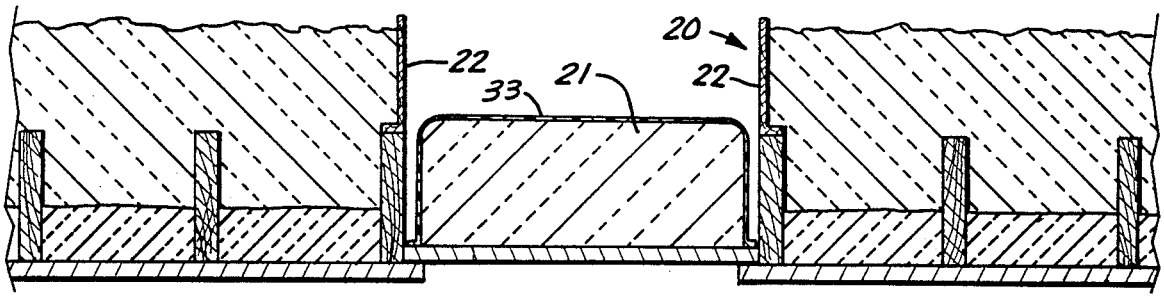
FIG. 2 is a partial side sectional view of a insulated attic with a second insulating layer having been added to the original insulating layer, incorporating the present invention.

Referring to the drawing, wherein like numerals represent like elements throughout the several views, there is shown an attic area 10 separated from a lower living area 11 by a ceiling 12 suspended from a plurality of ceiling joists 13 in the known fashion. A removable trap door 14 supported in the ceiling 12 provides a means of acess from the living area 11 to the attic area 10. A layer of thermal insulation 15 is placed between the joists 13. In the past, such a layer of insulation was typically an unrolled sheet of a woven fiberglass (shown in the drawing) or a layer of blown particulate insulation. The invention will be discussed in the context of adding additional insulation to existing construction, although it has utility in new construction as well.

One of the factors determining the degree of insulation (conventionally measured by a thermal resistance or "R" factor) is the depth of the insulating layer. Increasing the depth of the insulation increases the insulating ability of the layer. With high energy costs, it has become economically advantageous to add additional insulation to attics. One method of adding additional insulation in common use today is by blowing particles of insulation into the attic through a tube extending through the trap door and spreading the insulation evenly throughout the attic area. The ceiling joists provide a degree of lateral support to such insulation, but once the level of insulation extends above the joists, there is nothing to provide lateral support for the insulation around the trap door. Only by sloping or tapering the depth of the insulation from its main level to the level of the ceiling joists around the trap door (seen in FIG. 1) can loss of insulation through the trap door while it is open be prevented. This creates an area of decreased insulation depth over and surrounding the trap door that reduces the efficiency of the insulating layer.

To solve these problems, the present invention provides an attic insulating system comprising an expandable guard 20 designed to provide lateral support to the blown insulator layer immediately surrounding the trap door 14 and a trap door insulating pack 21 attached to the attic or top side of the trap door to provide insulation in the attic area immediately above the trap door.

Figure 3:
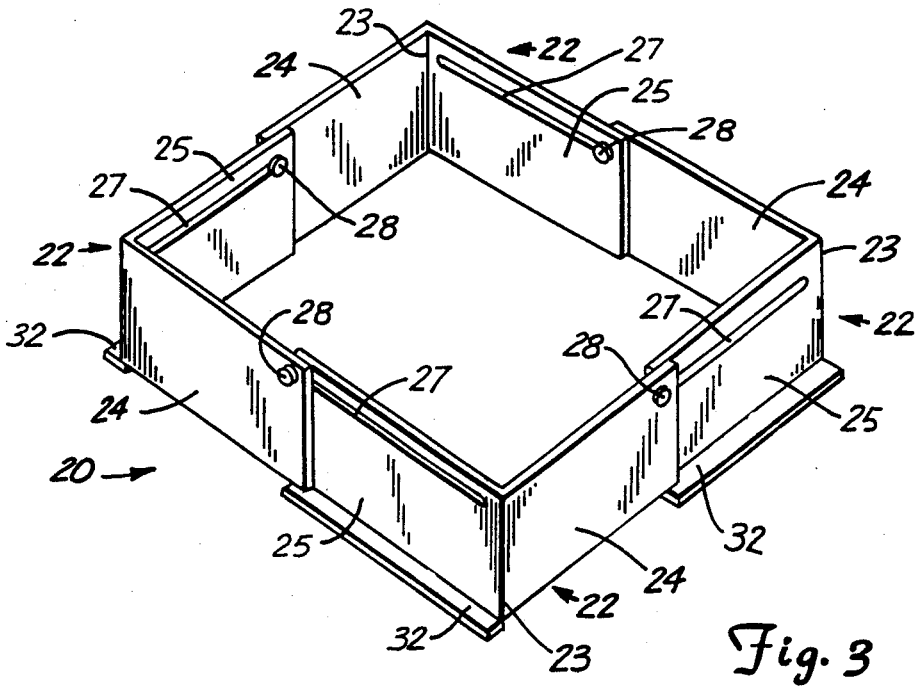
FIG. 3 is an elevational view of an expandable guard according to the present invention in an expanded condition.
Figure 4:
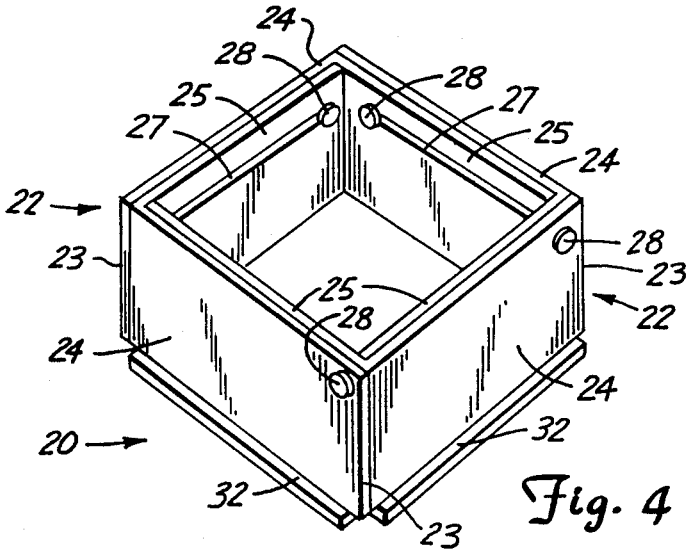
FIG. 4 is an elevational view of an expandable guard according to the present invention in a retracted condition.
Figure 5:
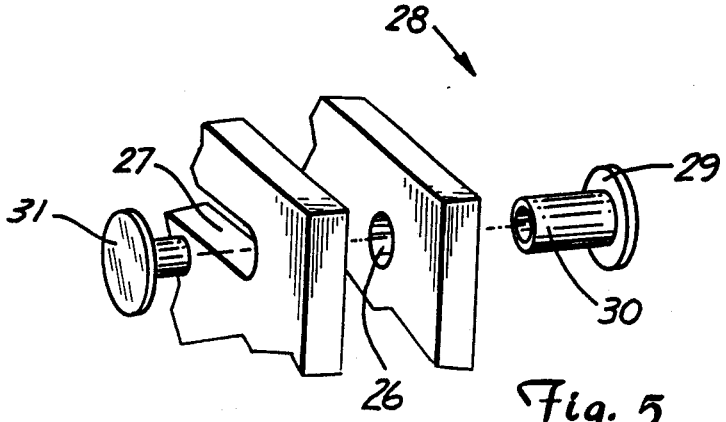
FIG. 5 is an exploded partial elevational view of a snap rivet construction which secures adjacent panels of the expandable guard according to the present invention.
Figure 6:
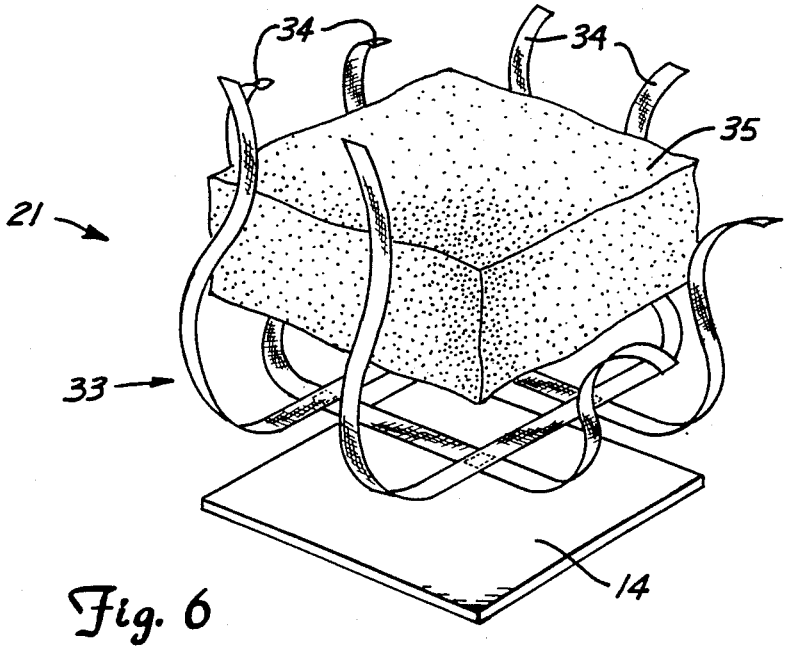
FIG. 6 is an exploded view of an insulated trap door according to the present invention.

As seen in FIGS. 3 and 4, the guard 20 is comprised of four generally rectangular members 22. Each member 22 is foldable along a vertical line to define a generally planar first panel 24 and a generally planar second panel 25 joined along a common edge 23. Each first panel 24 has a hole 26 defined adjacent its upper edge oppositely of the common edge 23. Each second panel 25 has a slot 27 defined along its upper edge at the same general vertical position as the hole 26, the slot 27 extending horizontally substantially all the length of the second panel 25. The members 22 are arranged in such a fashion that the first panel 24 of each member 22 overlaps a second panel 25 of the next adjacent member 22 with the hole 26 formed in each first panel 24 registered with the slot 27 of each respective overlapped second panel 25. A snap rivot 28 having a first expanded portion 29 attached at one end of a reduced radius portion 30 is inserted through each registered hole 26 and associated slot 27 such that the reduced radius portion 30 extends through the aligned opening and a second expanded portion 31 is attached (as by a known snap lock arrangement) to the free end of the reduced radius portion 30 oppositely of the first expanded portion 29. In this fashion, each member 22 is longitudinally slideably adjustable with respect to each of the adjacent other members 22 to which it is attached.

When all members 22 are folded along common edges 23 so that the respective first and second panels 24, 25 are maintained at right angles, a rectangular guard will be formed. The length of the respective parallel sides of the guard 20 can be adjusted by slideably adjusting the overlapped first and second panels 24,25 of adjacent members 22 to the desired degree of overlap. In this fashion, the guard 20 can be adjusted to the approximate size of the particular trap door involved in any given application. This is advantageous in that most joists are generally spaced either at either 16 or 24 inches between centers. By providing an adjustable guard in this fashion, a universal guard can be constructed and adjusted to whatever joist spacing situation is presented in any given application. Typically, the range of guard dimensions will be from 14–25 inches on the short sides (between joists) and 25–40 inches on the long side. The guard 20 can also be adjusted to its smallest size and folded into an essentially flat configuration for ease of transportation.

To facilitate the attachment of guard 20 to the joists 13, each of either the first or second panels 24, 25 is provided with an outwardly extending flange 32 along its bottom edge. The flange 32 can be stapled or nailed to the joists 13 to secure the guard in place.

The inventor has found it advantageous to construct the guard of corrugated cardboard, although any other suitable material will work equally as well within the scope of this invention.

Once the guard 20 has been adjusted to the desired size and is secured in place to the joists 13 and the insulation blown to the desired depth, the trap door 14 is insulated by attachment to its top side of a trap door insulating pack 21. The pack 21 comprises a harness 33 comprised of nylon or any other suitable material having opposed pairs of parallel straps 34, one pair of parallel straps 34 overlying the other at right angles with the overlying portions of such straps being sewn or otherwise secured to form the harness 33. One or more sheets of insulation 35 are cut to a size generally corresponding to the size of the trap door 14 and placed over the overlying parallel pairs of straps 34. For this application, interwoven fiberglass insulation is used. Such insulation generally is found in rolls having a substantially uniform thickness. Since the thickness of the insulation in part determines the thermal resistance, by using more than one layer of insulation above the trap door in the thermal pack 21, the thermal resistance (R value) can be increased. If necessary, to correspond to the R value of the blown insulation layer.

Once the desired number of layers of woven insulation is cut and placed in the harness 33, the free ends of the harness 33 are drawn over the top of the insulation and the overlying portions of such straps again are attached by any suitable means to enclose the insulation. The pack 21 is then attached to the top of the trap door 14 by staples or any other suitable means, and the trap door 14 is lowered through the guard 20 into place.

While I have herein described the preferred embodiment of my invention, it will be apparent to those of ordinary skill in the art that other embodiments are possible within the scope of my invention.

What is claimed is:

1. A system for insulating attics wherein access to the attic is had through an opening in the floor of the attic, which opening is normally closed by a trap door, comprising:

(a) an adjustably expandable guard, said guard being adjustable to a size and shape corresponding to the size and shape of said opening;

(b) means for securing said guard in surrounding and upwardly extending relation to said opening; and (c) a trap door insulating pack comprising a harness enclosing one or more layers of insulating material, said pack being attachable to said trap door such that said pack overlies essentially all said trap door.

2. A system for insulating attics according to claim 1, wherein said adjustably expandable guard comprises a plurality of interconnected panels, each of said panels being adjustably positionable with respect to each adjacent panel.

3. A system for insulating attics according to claim 1, wherein said expandable guard comprises four generally rectangular interconnected members, each of said members comprising a first panel and a second panel, each of said first panels being attached to the second panel of an adjacent member such that said first panel of said member is slideably positionable with respect to said second panel of said adjacent member.

4. A system for insulating attics according to claim 1, wherein said expandable guard comprises four generally interconnected members, each of said members comprising a first panel and second panel joined along a common line, wherein each of said second panels defines a generally horizontally slot and wherein each of said members is slideably attached to an adjacent member by a rivet extending through said slot in said member's second panel and affixed to said first panel of said adjacent member.

5. A system for insulating attics wherein access to the attic is had through an opening in the floor of the attic normally closed by a trap door, comprising:

(a) four generally rectagular interconnected members, each of said members comprising a first panel and a second panel, each of said panels being attached to the second panel of an adjacent member such that said first panel of said member is slideably positionably with respect to said second panel of said adjacent member;

(b) means for securing said members in surrounding and upwardly extending relationship to said opening; and (c) a trap door insulating pack comprising a harness enclosing one or more layers of insulating material, said pack being attachable to said trap door such that said pack overlays essentially all of said trap door.

6. A system for insulating attics wherein access to the attic is had through an opening in the floor of the attic normally closed by a trap door, comprising:

(a) four generally rectangulr interconnected members, each of said members comprising a first panel and second panel joined along a common line, wherein each of said second panels defines a generally horizontal slot and wherein each of said members are slideably attached to adjacent members by a rivet extending through said slot in said member's second panel and affixed to said first panel of said adjacent member, and wherein each of either of said first panels or said second panels defines an outwardly extended flange along its bottom edge; and (b) a trap door insulating pack comprising a harness enclosing one or more layers of insulating material, said pack being attached to said trap door such that said pack overlies essentially all said trap door.

* * * * *